US011143440B2

(12) United States Patent
Liu et al.

(10) Patent No.: US 11,143,440 B2
(45) Date of Patent: Oct. 12, 2021

(54) ACTIVE CONTROL ALTERNATING-DIRECT FLOW HYBRID MECHANICAL CRYOGENIC SYSTEM

(71) Applicant: Shanghai Institute of Technical Physics, Chinese Academy of Sciences, Shanghai (CN)

(72) Inventors: Shaoshuai Liu, Shanghai (CN); Yinong Wu, Shanghai (CN); Zhenhua Jiang, Shanghai (CN); Lei Ding, Shanghai (CN); Haifeng Zhu, Shanghai (CN); Baoyu Yang, Shanghai (CN); Xiaoping Qu, Shanghai (CN); Zhi Lu, Shanghai (CN); Zheng Huang, Shanghai (CN); Peng Zhao, Shanghai (CN)

(73) Assignee: Shanghai Institute of Technical Physics, Chinese Academy of Sciences, Shanghai (CN)

( * ) Notice: Subject to any disclaimer, the term of this patent is extended or adjusted under 35 U.S.C. 154(b) by 52 days.

(21) Appl. No.: 16/716,012

(22) Filed: Dec. 16, 2019

(65) Prior Publication Data

US 2021/0071916 A1 Mar. 11, 2021

(30) Foreign Application Priority Data

Sep. 11, 2019 (CN) ..... 201910857369.7

(51) Int. Cl.

| | |
|---|---|
| ***F25B 9/14*** | (2006.01) |
| ***F25B 41/40*** | (2021.01) |
| ***F25B 41/22*** | (2021.01) |
| *F25B 39/02* | (2006.01) |

(52) U.S. Cl.

CPC ..... *F25B 9/145* (2013.01); *F25B 41/22* (2021.01); *F25B 41/40* (2021.01); *F25B 39/02* (2013.01); *F25B 2309/1412* (2013.01); *F25B 2309/1418* (2013.01); *F25B 2309/1428* (2013.01); *F25B 2400/05* (2013.01)

(58) Field of Classification Search

CPC ..... F25B 9/145; F25B 41/40; F25B 41/22; F25B 39/02; F25B 2309/1412; F25B 2309/1418; F25B 2309/1428; F25B 2400/05

See application file for complete search history.

(56) References Cited

U.S. PATENT DOCUMENTS

2018/0045434 A1* 2/2018 Sato ..... F25B 6/04

* cited by examiner

*Primary Examiner* — David J Teitelbaum
(74) *Attorney, Agent, or Firm* — Klarquist Sparkman, LLP

(57) ABSTRACT

The disclosed subject matter includes an active control alternating-direct flow hybrid mechanical cryogenic system, and relates to the field of cryogenic refrigeration technologies. The active control alternating-direct flow hybrid mechanical cryogenic system includes a main compressor, a Stirling cold finger, an intermediate heat exchanger, a pulse tube cold finger, a first dividing wall type heat exchanger, a final precooled heat exchanger, a second dividing wall type heat exchanger, and an evaporator that are communicated successively, where the second dividing wall type heat exchanger is connected to the evaporator through a second connecting pipeline, and a throttling element is disposed on the second connecting pipeline; a pulse tube cold head of the pulse tube cold finger is communicated with the final precooled heat exchanger through a cold chain; and a check valve is disposed on the intermediate heat exchanger.

9 Claims, 1 Drawing Sheet

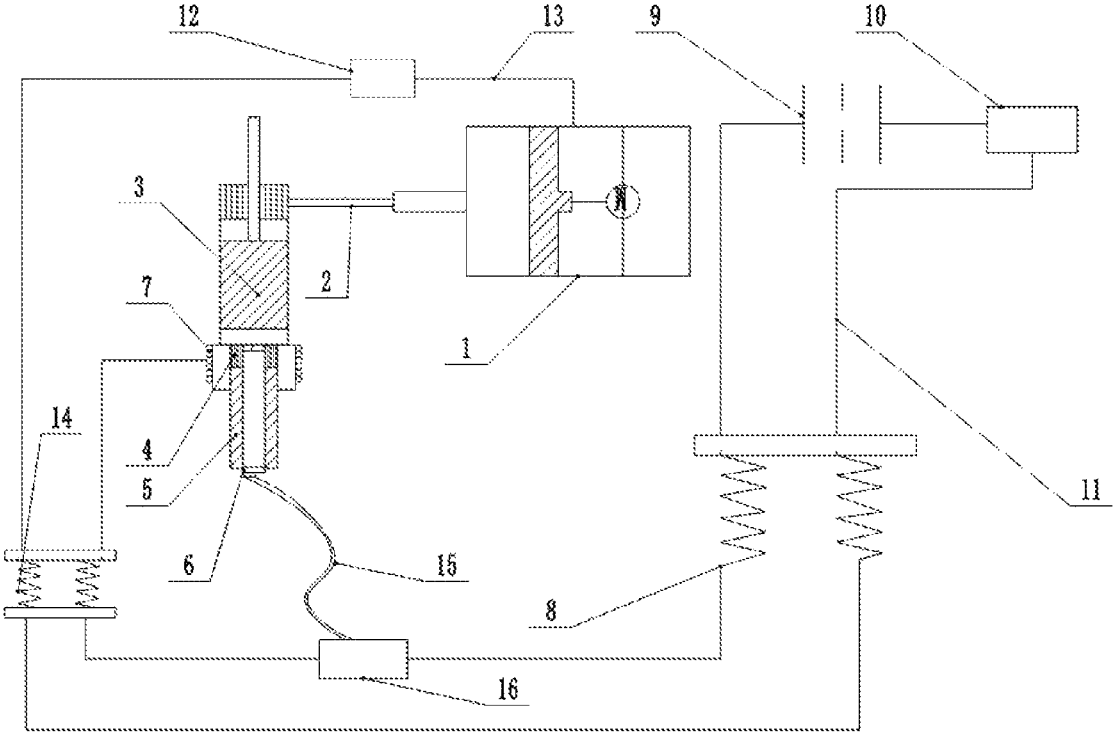
12
13
9
10
3
2
7
1
14
4
5
11
6
15
8
16

ACTIVE CONTROL ALTERNATING-DIRECT FLOW HYBRID MECHANICAL CRYOGENIC SYSTEM

CROSS-REFERENCE TO RELATED APPLICATIONS

This application claims the benefit of and priority to Chinese Patent Application No. CN 201910857369.7, entitled "ACTIVE CONTROL ALTERNATING-DIRECT FLOW HYBRID MECHANICAL CRYOGENIC SYSTEM," which was filed on Sep. 11, 2019. The entirety of Chinese Patent Application No. CN 201910857369.7 is incorporated herein by reference as if set forth fully herein.

TECHNICAL FIELD

The disclosed subject matter relates to the field of cryogenic refrigeration technologies, and in particular, to an active control alternating-direct flow hybrid mechanical cryogenic system.

BACKGROUND

The booming development of space science and technologies has provided a great boost for human to explore the universe. Over the most recent 30 years, the United States, the European Union, Japan, and other countries have launched a number of space exploration projects successively. To reduce background noise and improve a signal-to-noise ratio, sensitivity, and a resolution of an optical detector, the detector and its auxiliary optical equipment and electronic equipment often need to work in a cryogenic environment. For a high sensitivity detection apparatus made of a superconducting material, such as a superconducting quantum interference device and a superconducting bolometer, an appropriate cryogenic environment is a necessary condition for ensuring normal operation of a superconducting apparatus. For a superconducting quantum interference device (SQUID), a superconducting photon detector (SNSPD), a superconducting terahertz detector, deep space detectors such as a submillimeter wave explorer and a cosmic background explorer, a space refrigeration system needs to provide a temperature zone of 1-4 K or even extremely low temperature in a temperature zone of mK. The temperature zone of 1-4 K is also a required heat sink for obtaining the mK-level cold temperature. Therefore, a space low-temperature refrigeration system providing a temperature zone of 1-4 K is one of key technologies for implementing a space exploration mission.

A space mission has an extremely stringent requirement on the system reliability, especially in a deep space mission. For example, the distance of an ideal place L2 point for universe observation and astronomical research is about 150×104 km away from the earth, and this distance is one-tenth of a distance between the sun and the earth. Currently, it is difficult to maintain a spacecraft operating at this point. At present, cryogenic refrigeration technologies used in some space probes or telescopes that have been launched or will be launched in the world mainly include a passive mode (liquid helium Dewar technology) and an active mode (mechanical refrigeration technology). A scheme of direct cooling by liquid helium has characteristics such as mature technology and no vibration or interference, but as a space application, its service life is limited by an amount of liquid helium carried. A 1-4 K space cryogenic mechanical refrigeration technology has advantages of high efficiency, light weight, long life, high reliability, and the like, and is one of key technologies for better application of a space technology in the future.

One type of refrigerant in the temperature zone of 1-4 K is helium gas. Because the transition temperature of the helium gas is relatively low, pre-stage precooling is required. A main way to implement a space application in a liquid helium temperature zone is to use a JT refrigeration technology of regenerative refrigerator precooling. A currently used regenerative refrigerator mainly uses a pulse tube refrigeration technology. Air flow inside the regenerative refrigerator is in an alternating oscillation state and is limited by a physical property problem of a filler of a heat regenerator. An application temperature zone is generally 10-20 K. In a JT refrigeration technology in which a helium working medium is used, internal gas is in a direct flowing state, and an actual gas effect of the working medium is used to generate refrigeration performance. Combination of the two technologies can implement efficient refrigeration in the temperature zone of 1-4 K, which is a main technology of international space cryogenic refrigeration.

However, in a JT scheme precooled by a regenerative cooler for obtaining cryogenic refrigeration, a non-ideal gas effect of helium gas reduces the efficiency of a regenerative refrigeration technology in a temperature zone of 10-20 K, resulting in relatively high overall input power. On a JT side, due to the temperature span from room temperature to the temperature zone of 1-4 K, multiple heat exchanger components need to be additionally added. As a result, a system structure is relatively complex. The non-ideal gas effect of helium gas in the temperature zone of 10-20 K gradually increases, reducing efficiency of a pulse tube cold finger.

SUMMARY

An example practical application of the disclosed subject matter is to provide an active control alternating-direct flow hybrid mechanical cryogenic system and implement efficient and reliable refrigeration in a temperature zone of 1-4 K and with a compact structure.

To achieve the foregoing and other practical applications, certain examples of the disclosed subject matter may be used to provide one or more of the following technical aspects.

According to one aspect of the disclosed technology, an active control alternating-direct flow hybrid mechanical cryogenic system includes a main compressor, a Stirling cold finger, an intermediate heat exchanger, a pulse tube cold finger, a first dividing wall type heat exchanger, a final precooled heat exchanger, a second dividing wall type heat exchanger, and an evaporator that are communicated successively, where the second dividing wall type heat exchanger is connected to the evaporator through a second connecting pipeline, and a throttling element is disposed on the second connecting pipeline; a pulse tube cold head of the pulse tube cold finger is communicated with the final precooled heat exchanger through a cold chain; and a check valve is disposed on the intermediate heat exchanger.

In some examples, the main compressor is connected to the Stirling cold finger through a first connecting pipeline.

In some examples, the active control alternating-direct flow hybrid mechanical cryogenic system further includes a pressure regulating unit, wherein one end of the pressure regulating unit is communicated with the first dividing wall type heat exchanger, and the other end of the pressure regulating unit is communicated with the main compressor to form a closed direct-flow loop.

In some examples, the second dividing wall type heat exchanger is connected to the pressure regulating unit through a JT return pipeline.

In some examples, the pressure regulating unit is connected to the main compressor through a JT return connecting pipeline.

In some examples, the pressure regulating unit is a conventional oil-free pump, a linear compressor or a gas reservoir.

Certain examples of the disclosed subject matter may be used to provide one or more of the following technical aspects.

In some examples, disclosed subject matter provides an active control alternating-direct flow hybrid mechanical cryogenic system, including a main compressor, a Stirling cold finger, an intermediate heat exchanger, a pulse tube cold finger, a first dividing wall type heat exchanger, a final precooled heat exchanger, a second dividing wall type heat exchanger, and an evaporator that are communicated successively, where regenerative alternating flowing and JT direct flowing are coupled, a throttling element and a check valve are used for active control, and a controllable ratio relationship between pressure and a flow rate is adjusted to implement efficient and reliable refrigeration in a temperature zone of 1-4 K and with a compact structure.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. The foregoing and other aspects and features of the disclosed technology will become more apparent from the following detailed description, which proceeds with reference to the accompanying FIGURES.

BRIEF DESCRIPTION OF THE DRAWINGS

To describe the technical solutions in the embodiments of the disclosed subject matter more clearly, the following briefly introduces the accompanying drawings required for describing the embodiments. The accompanying drawings in the following description show merely some example embodiments of the disclosed subject matter, and a person of ordinary skill in the art having the benefit of the present disclosure may still derive other drawings from these accompanying drawings following the same principles disclosed herein.

FIG. 1 is a schematic structural diagram of an active control alternating-direct flow hybrid mechanical cryogenic system according to the disclosed technology. The displayed reference numbers respectively represent:

1—main compressor; 2—first connecting pipeline; 3—Stirling cold finger; 4—intermediate heat exchanger; 5—pulse tube cold finger; 6—pulse tube cold head; 7—check valve; 8—second dividing wall type heat exchanger; 9—throttling element; 10—evaporator; 11—JT return pipeline; 12—pressure regulating unit; 13—JT return connecting pipeline; 14—first dividing wall type heat exchanger; 15—cold chain; and 16—final precooled heat exchanger.

DETAILED DESCRIPTION

The following describes examples of the disclosed subject matter with reference to the accompanying drawings. The described examples are merely representative rather than all possible embodiments of the disclosed subject matter.

According to one aspect of the disclosed subject matter, methods and apparatus are provided for an active control alternating-direct flow hybrid mechanical cryogenic system, and implement an efficient and reliable refrigeration in a temperature zone of 1-4 K and with a compact structure.

To make the foregoing subject matter clearer and more comprehensible, the disclosed subject matter is further described in detail below with reference to the accompanying drawings and specific embodiments.

As shown in FIG. 1, an embodiment provides an active control alternating-direct flow hybrid mechanical cryogenic system. The system can include a main compressor 1, a Stirling cold finger 3, an intermediate heat exchanger 4, a pulse tube cold finger 5, a first dividing wall type heat exchanger 14, a final precooled heat exchanger 16, a second dividing wall type heat exchanger 8, and an evaporator 10 that are communicated successively, so as to couple regenerative alternating flowing and JT direct flowing, to satisfy a cryogenic refrigeration requirement of 1-4 K. The second dividing wall type heat exchanger 8 can be connected to the evaporator 10 through a second connecting pipeline, and a throttling element 9 can be disposed on the second connecting pipeline; a pulse tube cold head 6 of the pulse tube cold finger 5 can be connected to the final precooled heat exchanger 16 through a cold chain 15; a check valve 7 can be disposed on the intermediate heat exchanger 4; fluid can pass through the check valve 7 and implement direct flowing to serve as high pressure fluid for JT refrigeration; the first dividing wall type heat exchanger 14 can be used to precool the high pressure fluid, the throttling element 9 and the check valve 7 can be used for active control, and a controllable ratio relationship between pressure and a flow rate can be adjusted to implement efficient and reliable refrigeration in the temperature zone of 1-4 K and a compact structure.

The main compressor 1 can be connected to the Stirling cold finger 3 through a first connecting pipeline 2.

The active control alternating-direct flow hybrid mechanical cryogenic system can further include a pressure regulating unit 12, wherein one end of the pressure regulating unit 12 can be communicated with the first dividing wall type heat exchanger 14, and the other end of the pressure regulating unit 12 can be communicated with the main compressor 1 to form a closed loop. The pressure regulating unit 12 can be used to increase pressure of return fluid to make it equal to pressure of fluid inside the main compressor 1.

The second dividing wall type heat exchanger 8 can be connected to the pressure regulating unit 12 through a JT return pipeline 11.

The pressure regulating unit 12 can be connected to the main compressor 1 through a JT return connecting pipeline 13.

The pressure regulating unit 12 can be a conventional oil-free pump, a linear compressor, or a gas reservoir.

An example implementation method is as follows:

Helium gas can be compressed in the main compressor 1 to generate alternating flow pressure fluctuation, and enter the Stirling cold finger 3 through the first connecting pipeline 2; a part of gas flowing from the Stirling cold finger 3 can be split and enter the pulse tube cold finger 5 through the intermediate heat exchanger 4; flow-rate-controllable low-temperature helium gas flowing in one way can be exported at the intermediate heat exchanger through the check valve 7, and enter into the throttling element 9 through the second dividing wall type heat exchanger 8; after the low-temperature helium gas passes through the throttling element 9 and is expanded, two-phase low-temperature fluid can be generated in the evaporator 10 to provide cold; the fluid can enter the pressure regulating unit 12 in a normal temperature zone after passing through the second dividing wall type heat exchanger 8 and the JT return pipeline 11, to increase fluid pressure to close to pressure of a back pressure chamber of the main compressor 1; and finally the fluid can enter the main compressor 1 though the JT return connecting pipeline 13 to form a whole closed loop, so as to implement an efficient and reliable refrigeration with a compact structure.

The refrigeration system may simultaneously obtain coldness at a Stirling location (40-80 K), a pulse tube location (10-30 K), and an evaporator (1-4 K).

Conversion between an alternating flow and a direct flow can be implemented at the intermediate heat exchanger component, so as to improve the efficiency of cryogenic pulse tube refrigeration, and obtain a cryogenic compact structure.

The Stirling cold finger 3 can be connected to the pulse tube cold finger 5 through the intermediate heat exchanger 4.

The intermediate heat exchanger 4 can be a structure capable of implementing pulse tube precooling and air flow distribution, and can also be used to precool an air reservoir phase modulation component of an inertia tube of the pulse tube cold finger 5.

The intermediate heat exchanger 4 may be used as a Stirling cold head to obtain cold.

The intermediate heat exchanger 4 may be provided with the check valve 7 for implementing air direct-flow flow in a pulse tube.

A direct flow closed-loop can be implemented through the pressure regulating unit 12 alone, or can be implemented in a manner of combined regulation of the pressure regulating unit 12 and the check valve 7.

The check valve 7 on the intermediate heat exchanger 4 can be a structure that can be opened or closed at a high frequency at low temperature.

The final precooled heat exchanger 16 can be arranged on a high-pressure pipeline, and can be in thermal connection with the pulse tube cold head through the cold chain 15.

A heat exchange flow channel may be machined at the pulse tube cold head, and is used for precooling and heat exchange of direct-flow air flowing out from the intermediate heat exchanger 4 through the second dividing wall type heat exchanger 8.

The second dividing wall type heat exchanger 8 can be added between high pressure air flow flowing out from the intermediate heat exchanger 4 and the final precooled heat exchanger 16, to recover cold.

Several examples are used for illustration of the principles and implementation methods of the disclosed subject matter. The description of the embodiments is used to help illustrate the method and its core principles of the disclosed subject matter. In addition, it will be understood that those of ordinary skill in the art having the benefit of the present disclosure can make various modifications in terms of specific embodiments and scope of application in accordance with the teachings of the disclosed subject matter.

In view of the many possible embodiments to which the principles of the disclosed subject matter may be applied, it should be recognized that the illustrated embodiments are only preferred examples and should not be taken as limiting the scope of the claims to those preferred examples. Rather, the scope of the claimed subject matter is defined by the following claims. We therefore claim as our invention all that comes within the scope of these claims.

We claim:

1. An active control alternating-direct flow hybrid mechanical cryogenic system, comprising a main compressor, a Stirling cold finger, an intermediate heat exchanger, a pulse tube cold finger, a first dividing-wall heat exchanger, a final precooled heat exchanger, a second dividing-wall exchanger, and an evaporator that are communicated successively, wherein the second dividing-wall exchanger is connected to the evaporator through a second connecting pipeline, and a throttling element is disposed on the second connecting pipeline; wherein a pulse tube cold head of the pulse tube cold finger is communicated with the final precooled heat exchanger through a cold chain; and wherein a check valve is disposed on the intermediate heat exchanger.

2. The active control alternating-direct flow hybrid mechanical cryogenic system according to claim 1, wherein the main compressor is connected to the Stirling cold finger through a first connecting pipeline.

3. The active control alternating-direct flow hybrid mechanical cryogenic system according to claim 1, further comprising a pressure regulating unit, wherein one end of the pressure regulating unit is communicated with the first dividing-wall heat exchanger, and the other end of the pressure regulating unit is communicated with the main compressor to form a closed direct-flow loop.

4. The active control alternating-direct flow hybrid mechanical cryogenic system according to claim 3, wherein the second dividing-wall heat exchanger is connected to the pressure regulating unit through a JT return pipeline.

5. The active control alternating-direct flow hybrid mechanical cryogenic system according to claim 3, wherein the pressure regulating unit is connected to the main compressor through a JT return connecting pipeline.

6. The active control alternating-direct flow hybrid mechanical cryogenic system according to claim 3, wherein the pressure regulating unit is a conventional oil-free pump, a linear compressor, or a gas reservoir.

7. The active control alternating-direct flow hybrid mechanical cryogenic system according to claim 1, further comprising an oil-free pump, a linear compressor, or a gas reservoir.

8. The active control alternating-direct flow hybrid mechanical cryogenic system according to claim 1, further comprising an oil-free pump, a linear compressor, or a gas reservoir having one end in communication with the first dividing-wall heat exchanger and another end in communication with the main compressor to form a closed direct-flow loop.

9. The active control alternating-direct flow hybrid mechanical cryogenic system according to claim 1, further comprising a pressure regulator having one end in communication with the first dividing-wall heat exchanger and another end in communication with the main compressor to form a closed direct-flow loop.

* * * * *